US010919061B2

(12) United States Patent
Bhandari

(10) Patent No.: US 10,919,061 B2
(45) Date of Patent: Feb. 16, 2021

(54) MULTI-FLUID DISPENSER

(71) Applicant: Bishal Bhandari, Medfield, MA (US)

(72) Inventor: Bishal Bhandari, Medfield, MA (US)

( * ) Notice: Subject to any disclaimer, the term of this patent is extended or adjusted under 35 U.S.C. 154(b) by 0 days.

(21) Appl. No.: 16/487,890

(22) PCT Filed: Mar. 12, 2018

(86) PCT No.: PCT/US2018/021918
§ 371 (c)(1),
(2) Date: Aug. 22, 2019

(87) PCT Pub. No.: WO2018/169823
PCT Pub. Date: Sep. 20, 2018

(65) Prior Publication Data

US 2020/0114381 A1 Apr. 16, 2020

Related U.S. Application Data

(60) Provisional application No. 62/472,161, filed on Mar. 16, 2017.

(51) Int. Cl.

| | |
|---|---|
| ***B05B 11/00*** | (2006.01) |
| ***A45D 34/06*** | (2006.01) |
| ***B05B 12/14*** | (2006.01) |
| *A45D 34/00* | (2006.01) |
| *A47K 5/12* | (2006.01) |

(52) U.S. Cl.
CPC ..... *B05B 11/0038* (2018.08); *A45D 34/06* (2013.01); *B05B 11/3084* (2013.01); *B05B 12/1409* (2013.01); *A45D 2034/005* (2013.01); *A45D 2200/052* (2013.01); *A45D 2200/054* (2013.01); *A47K 5/1201* (2013.01)

(58) Field of Classification Search
CPC ..... B05B 11/0038; B05B 11/3084; B05B 12/1409; A47K 5/1201; B65D 83/56; B65D 83/205; B65D 83/68; A45C 13/1069; A45D 40/24; A45D 34/06; A45D 2200/052; A45D 2200/054; A45D 2200/057
USPC ..... 222/135, 143, 325, 183
See application file for complete search history.

(56) References Cited

U.S. PATENT DOCUMENTS

| | | | | |
|---|---|---|---|---|
| 3,084,871 | A * | 4/1963 | Puglis | B65D 83/386 239/305 |
| 2011/0036867 | A1* | 2/2011 | Flores | B05B 11/0078 222/144.5 |
| 2012/0031925 | A1* | 2/2012 | Greenberg | B65D 83/68 222/135 |
| 2014/0054317 | A1* | 2/2014 | Brugger | B65D 83/68 222/135 |
| 2014/0138378 | A1* | 5/2014 | Lequeux | B65D 43/22 220/23.83 |
| 2014/0183226 | A1* | 7/2014 | Fily | B65D 25/20 222/143 |
| 2017/0238666 | A1* | 8/2017 | Chinlund | A45C 13/02 |
| 2017/0325570 | A1* | 11/2017 | Davtyan | A45D 40/24 |
| 2019/0183230 | A1* | 6/2019 | Denece | A45D 40/00 |

* cited by examiner

*Primary Examiner* — Donnell A Long
(74) *Attorney, Agent, or Firm* — Limor Gabay

(57) ABSTRACT

The Invention relates to a gadget (multi-fluid dispenser) that allows a user to carry multiple fluids in one portable device. The multi-fluid dispenser (MFD) features capsules which fit in a cylindrical shell, wherein each capsule is used to store fluid. A removable cap allows a user to select and dispense liquid from a capsule of choice.

14 Claims, 10 Drawing Sheets

MULTI-FLUID DISPENSER

TECHNICAL FIELD

The presently disclosed subject matter relates generally to a travel system that allows a user to carry multiple fluids in one portable device. The Multi Fluid Dispenser (MFD) features capsules which fit in a cylindrical shell, wherein each capsule is used to store fluid.

BACKGROUND

The present disclosure describes a portable liquid dispenser which holds and dispenses multiple separate fluids. Fluid dispensers have long been recognized as a convenient and sanitary means of dispensing bath and skin care products, such as liquid soap, shampoo, conditioner, body wash, face wash, skin lotion, etc.

A major problem confronting consumers is the inability of fluid dispensers to be easily transported. Many travelers need to take a variety of bath or skin care products, but not necessarily a large amount of each, and are forced to transport separate dispensers and containers for lack of a more suitable alternative. Transporting separate fluid containers unnecessarily increases the weight of one's luggage and consumes valuable luggage space. In addition, separate, conventional dispensers are prone to leaks or accidently opening during travel.

Accordingly, there is a need in the field for a compact and portable multi-fluid dispenser capable of separately storing and dispensing a variety of fluids.

SUMMARY

The present invention is a portable multi-fluid dispenser for use when separately storing and dispensing a plurality of fluids such as, but not limited to liquid soap, shampoo, conditioner, body wash, face wash, skin lotion and various oils. The portable multi-fluid dispenser comprises an outer shell, a plurality of capsules and a removable cap.

More specifically, the present disclosure provides a multi-fluid dispenser comprising a cylindrical outer shell closed on one end, a removable cap which closes the open end of the outer shell, a plurality of capsules which fit inside the outer shell, and a plurality of pump caps, wherein each pump cap of said plurality of pump caps is in fluid communication with a capsule of said plurality of capsules for dispensing fluid from said capsules, and wherein said pump caps fit on the openings of said capsules.

In some embodiments of the portable multi-fluid dispenser, said cylindrical outer shell comprises a plurality of vertical see-through slits, wherein said slits allow viewing of the level, color and texture of fluids in said capsules, and wherein said texture comprises of characteristics such as viscosity and opacity.

In some embodiments of the portable multi-fluid dispenser, said plurality of vertical see-through slits allow viewing of labels affixed to said capsules, wherein said labels comprise stickers, prints, writing or engravements.

In some embodiments of the portable multi-fluid dispenser, the inside part of said cylindrical outer shell comprises a plurality of vertical protrusions.

In some embodiments of the portable multi-fluid dispenser, the outside of each said capsule comprises two vertical grooves, and said vertical grooves fit onto said vertical protrusions of said inside part of said cylindrical outer shell.

In some embodiments of the portable multi-fluid dispenser, said removable cap is secured to the cylindrical outer shell by magnetic force attraction, and a user may remove said removable cap from said outer shell by pulling.

In some embodiments of the portable multi-fluid dispenser, said removable cap snaps into places via a bending beam, wherein said bending beam contains a round protrusion which snaps into mating circular protrusions on the outside portion of said cylindrical outer shell.

In some embodiments of the portable multi-fluid dispenser, a side portion of said removable cap comprises a side opening through which dispensed fluid may be collected.

In some embodiments of the portable multi-fluid dispenser, the top portion of said removable cap comprises a partly detached portion comprising a protrusion into the inside of said removable cap, and wherein said partly detached portion may be pressed down to allow said protrusion to press down on a pump cap and thus cause the fluid present in the capsule in fluid communication with said pump cap to be dispensed.

In some embodiments of the portable multi-fluid dispenser, said removable cap rotates horizontally while secured to the cylindrical outer shell, said removable cap can thus be secured to the cylindrical outer shell in a number of pre-determined positions, thus the side opening can be positioned in front of a pump cap of the user's choice.

In some embodiments of the portable multi-fluid dispenser, said removable cap rotates horizontally while secured to the cylindrical outer shell, said removable cap can thus be secured to the cylindrical outer shell in a number of pre-determined positions, and the side opening can be thus positioned in between two of the pump caps, wherein said position prevents dispense of fluids.

In some embodiments of the portable multi-fluid dispenser, said multi-fluid dispenser further comprises a deodorant, wherein said deodorant is attached to the closed end of said outer shell via a tight-fitting sleeve.

In some embodiments of the portable multi-fluid dispenser, said deodorant is attached to the closed end of said outer shell by magnetic force attraction.

In some embodiments of the portable multi-fluid dispenser, said deodorant is a spray deodorant.

In some embodiments of the portable multi-fluid dispenser, said multi-fluid dispenser comprises 4 capsules.

In some embodiments of the portable multi-fluid dispenser, said multi-fluid dispenser comprises 2 or 3 capsules.

In some embodiments of the portable multi-fluid dispenser, said multi-fluid dispenser comprises 5 or 6 capsules.

In some embodiments of the portable multi-fluid dispenser, said capsules are disposable.

In some embodiments of the portable multi-fluid dispenser, said multi-fluid dispenser is disposable.

A method of using the presently disclosed multi-fluid dispenser comprises the steps of:

(a) pulling off the removable cap from the cylindrical outer shell;

(b) filling the capsules with liquids of choice;

(c) securing a pump cap on each capsule;

(c) labeling the capsules according to content;

(d) inserting the capsules into the cylindrical outer shell;

(e) re-placing the removable cap onto the cylindrical outer shell;

(f) rotating the removable cap horizontally so that the side opening of the removable cap is in front of the pump cap of choice; and, (g) pressing down on the partly detached portion of the removable cap to dispense liquid, wherein each time the partly detached portion is pressed down a certain amount of said liquid is dispensed, thus step (g) may be performed as many times as needed to dispense the desired amount of liquid.

DETAILED DESCRIPTION

The present disclosure provides a portable multi-fluid dispenser (also referred to herein as "MFD") for use in separately storing and dispensing a plurality of fluids. The presently disclosed subject matter now will be described more fully hereinafter with reference to the accompanying drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated drawings. Therefore, it is to be understood that the presently disclosed subject matter is not to be limited to the specific embodiments disclosed and that modifications and other embodiments are intended to be included within the scope of the appended claims.

Figure 1:
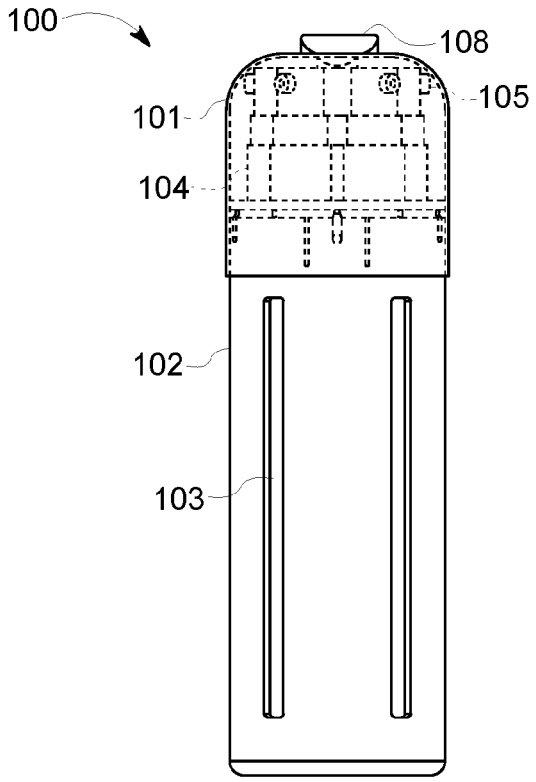
FIG. 1 illustrates a side view of an embodiment of the presently disclosed portable multi-fluid dispenser. Dashed lines depict pump caps comprising nozzles.
Figure 2:
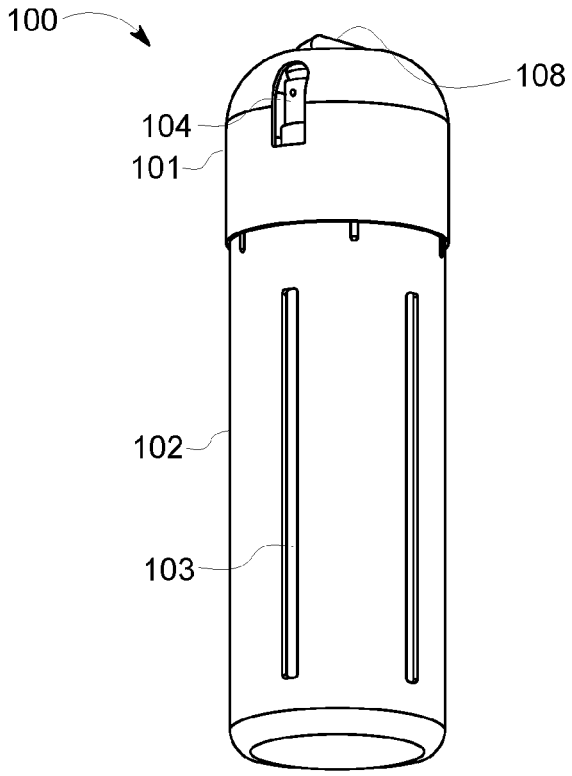
FIG. 2 illustrates a perspective view of an embodiment of the presently disclosed portable multi-fluid dispenser depicting side opening and partly detached portion of the removable cap.

Referring now to FIG. 1 which depicts an embodiment of the MFD 100, featuring an outer shell 102, vertical see-through slits 103 in said outer shell, a removable cap 101, a partly detached portion of the removable cap 108, pump caps 104 and nozzle parts of said pump caps 105. FIG. 2 illustrates a perspective view of an embodiment of the MFD 100 depicting a side opening in the removable cap 101, through which a pump cap 104 is visible. When a user presses down on the partly detached portion of the removable cap 108, the pumping operation of the pump cap 105 showing through the removable cap 101 side opening is activated, and a certain amount of the fluid present in the capsule 200 connected to said pump cap 104 is dispensed via the pump cap nozzle 105, said dispensed fluid may then be collected by the user. All the different elements of the MFD 100 such as cylindrical outer shell 102, removable cap 101, partly detached portion of the removable cap 108, deodorant and sleeve (shown at least in FIGS. 3 and 4—numbered, respectively, 106 and 107), capsules (a capsule is shown at least in FIG. 6, and assigned the number 200) and pump caps 104 comprising nozzles 105 may be made out of any material commonly used in the art, including but not limited to, polymeric material, composites, alloys, metal. In a preferred embodiment, the removable cap 101 and outer shell 102 is made out of ABS (Acrylonitrile butadiene styrene) and the capsules are made out of Copolyester resin. In some embodiments, the different elements of the MFD are each made of any suitable material or combination of materials. It will be recognized by those with ordinary skill in the art that said different elements may be fashioned from any suitable material. Each element of the MFD may be fashioned as one part, or an element may be fashioned as at least two parts that are subsequently attached together to form the element.

The removable cap rotates horizontally while attached to the cylindrical outer shell, thus the side opening may be positioned by a user in front of a pump cap of choice, thereby enabling the user to select the capsule from which fluid will be dispensed. In some embodiments of the MFD 100, the removable cap snaps into said positions via a bending beam, which contains a round protrusion that snaps into mating circular protrusions when located at a desired position. In other embodiments, the removable cap 101 is secured to the cylindrical outer shell 102 by magnetic force attraction, and can be rotated horizontally to be secured to said outer shell in a plurality of pre-determined positions. Additionally, in some embodiments of the MFD 100, a user is able to "lock" the MFD 100 (not shown), wherein in such position the side opening of the removable cap 101 is placed in between two pumps caps 104, thus pressing down on the partly detached part 108 of the removable cap 101 does not activate the pumping operation of any of the pump caps 104, thereby preventing an accidental dispense of fluid when the MFD 100 is not in use. By horizontal rotation, is meant herein that when the MFD 100 is looked at from above, the removable cap 101 may be rotated in either clockwise or anticlockwise direction, and thus be secured to the cylindrical outer shell 102 in a number of pre-determined positions.

Figure 10:
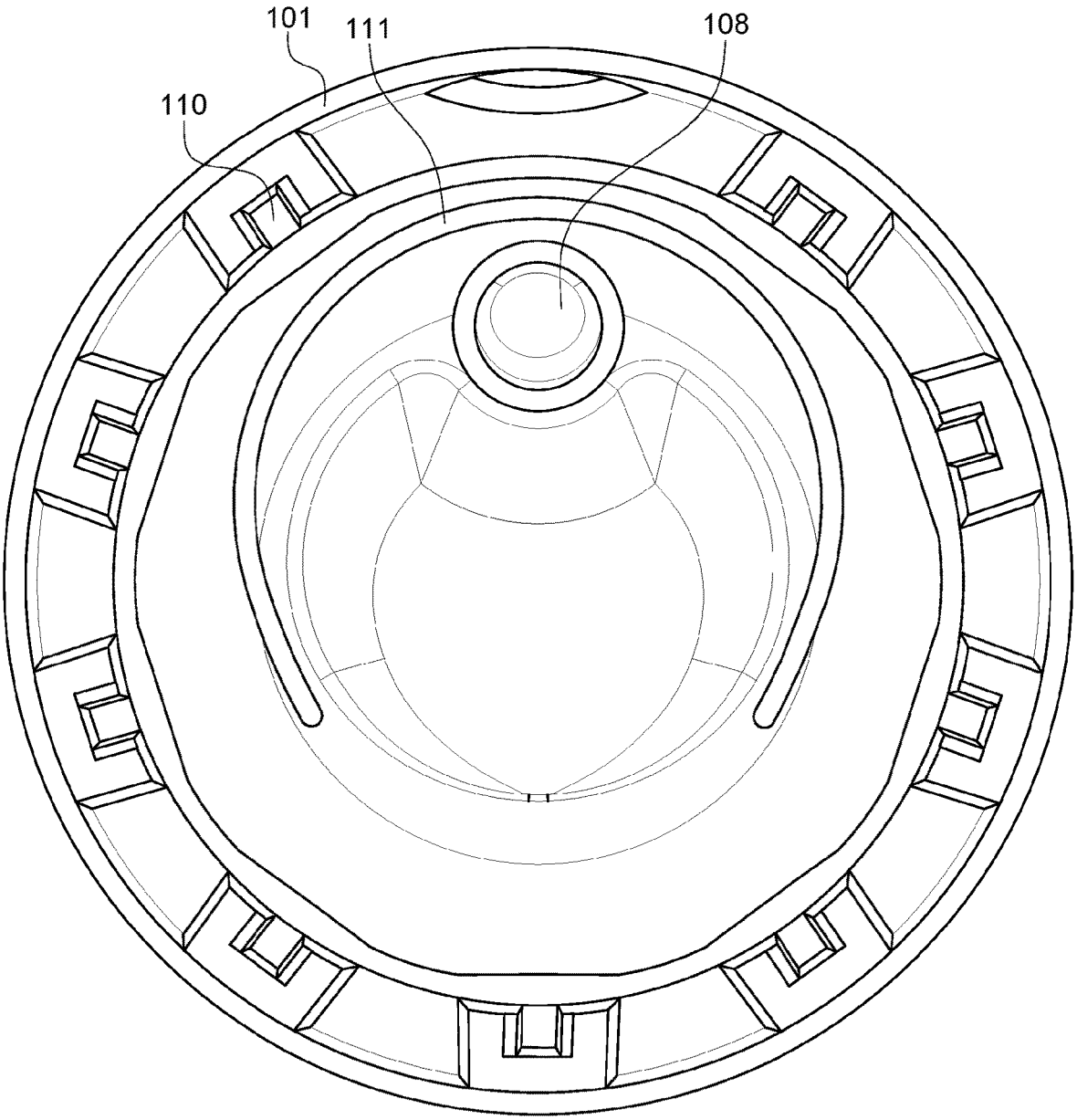
FIG. 10 illustrates a top sectional view of an embodiment of the removable cap.

In some embodiments of the MFD 100, fluid is dispensed by pressing down on the partly detached portion 108 of the removable cap 101. The detachment 111 between the partly detached portion 108 and the removable cap 101 is shown in FIG. 10. The inside of the partially detached portion 108 comprises a protrusion (shown in the top sectional view illustrated in FIG. 10). This protrusion does not press down on the pump caps 104 when the MFD 100 is not used. In a preferred embodiment, said protrusion does not touch the pump caps 104 when the partly detached portion 108 is not pressed down. However, when the partly detached portion 108 is pressed down, it presses down the pump cap 104 of choice, just as a user's finger would. As the user presses down on the partly detached portion 108, he or she is using one singular dispenser and dispensing a certain amount of liquid. The inside protrusion of the partially detached portion 108 of the removable cap 101 may have any suitable shape and size, as long as it allows said protrusion to effectively press down on a pump cap 104. The shape of said protrusion may be, without limitation, circular, square, elliptical or rectangular. The pump cap 104 used in the MFD 100, may be any type of pump cap traditionally used in the art. In some embodiments of the presently disclosed MFD 100, the pump cap 104 comprises a straw part to enable reaching and dispensing fluids present in the bottom of the capsules 200. In some embodiments of the presently disclosed MFD 100, the nozzle part 105 of the pump cap 104, can be "locked" by the user into a position in which the nozzle is aimed toward the center of the round side of the capsule 200 (the round side of the capsule is shown at least in FIG. 6). The user performs said locking of the nozzle 105 after securing the pump cap 104 to the capsule 200, by rotating the portion of the pump cap 104 which comprises the nozzle 105.

In some embodiments, the capsule 200 and pump cap 104 comprise markings, such as arrows, to assist the user in positioning the nozzle in the position described above. Said position ensures that dispensed liquids squirt through the removable cap 101 side opening.

In the MFD embodiment according to which the removable cap 101 is secured to the cylindrical outer shell 102 by magnetic force, a user may replace a capsule 200 by removing said removable cap 101, which is done by pulling said removable cap 101 away from the outer cylindrical shell 102, thereby making the capsules 200 accessible. The capsule, or capsules, then may be pulled out and a new capsule, or a re-filled capsule, may be fitted inside the MFD 100. Alternatively, once the removable cap 101 is removed from the cylindrical outer shell 102, the pump cap 104 may be removed from a capsule 200, or capsules, of choice, and the capsule/s may be filled, or re-filled, with liquid. The pump cap/s 104 and the removable cap 101 may then be re-secured to the capsules 200 and outer cylindrical shell 102, respectively, and the MFD is then ready for use.

Figure 3:
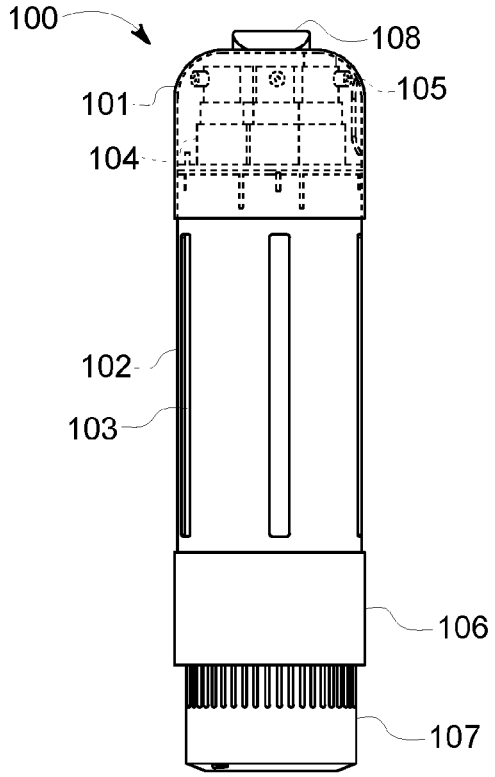
FIG. 3 illustrates a side view of an embodiment of the presently disclosed portable multi-fluid dispenser depicting the spray deodorant attached to the bottom of the outer shell wherein the spray deodorant is in a closed position.

FIG. 3 depicts an embodiment of the MFD 100 featuring a spray deodorant 107 attached to the closed end of the MFD via a tight-fitting sleeve 106, wherein the spray deodorant is in a closed position. In some embodiments of the MFD, the deodorant may be attached to the closed end of the cylindrical outer shell 102 using magnetic force attraction (not shown). The deodorant according to the present disclosure may be any type of deodorant such as, without limitation, spray deodorant or roll-on deodorant.

Figure 4:
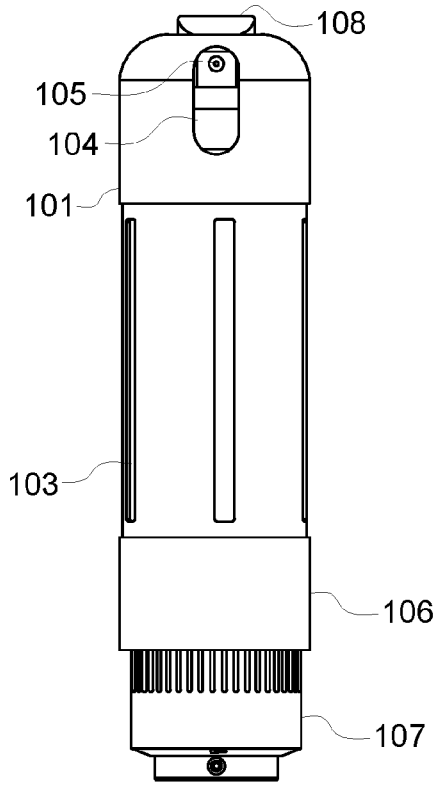
FIG. 4 illustrates a side view of an embodiment of the presently disclosed portable multi-fluid dispenser depicting the spray deodorant attached to the bottom of the outer shell wherein the spray deodorant is in opened position.

FIG. 4 depicts an embodiment of the MFD 100 featuring a spray deodorant 107 attached to the closed end of the MFD 100 via a tight-fitting sleeve 106, wherein the spray deodorant 107 is in opened position. To attach said spray deodorant, said tight fitting sleeve 106 slides over the bottom of the cylindrical outer shell 102. In another embodiment, said tight-fitting sleeve 106 snaps to the bottom of the cylindrical outer shell 102. A person skilled in the art will appreciate that the spray deodorant 107 may be attached to the closed end (bottom) of the cylindrical outer shell 102 by any suitable means, preferably magnetic force attraction. The MFD 100 may or may not comprise the spray deodorant attachment.

Figure 5:
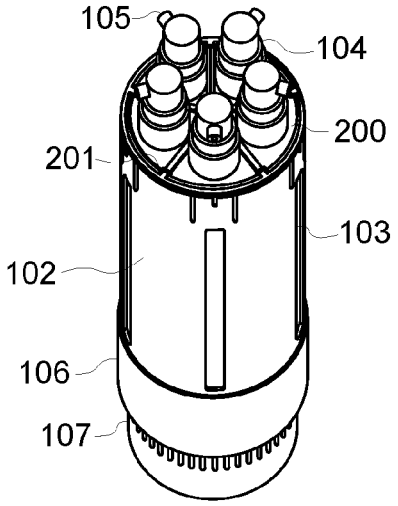
FIG. 5 illustrates a perspective view of an embodiment of the presently disclosed portable multi-fluid dispenser depicting the multi-fluid dispenser with the removable cap off.
Figure 6:
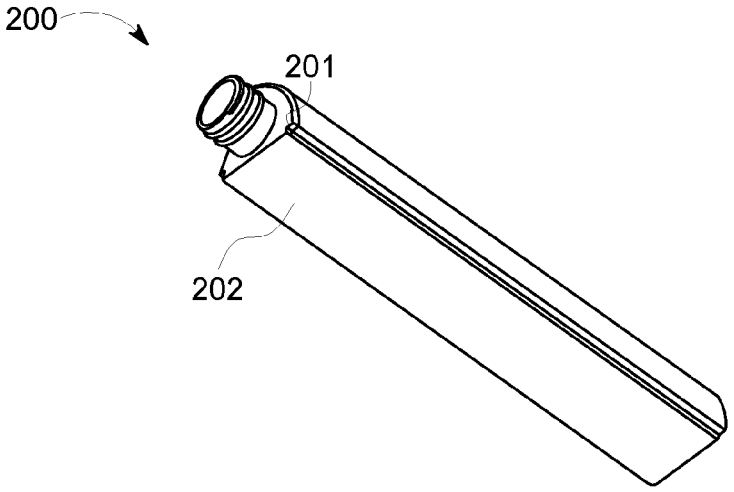
FIG. 6 illustrates a perspective view of an embodiment of a capsule depicting the vertical side grooves.

FIG. 5 is a perspective view of an embodiment of the MFD 100, depicting five capsules 200 fitting inside the cylindrical outer shell 102, wherein said capsules 200 feature a vertical groove (shown in FIG. 6, and assigned the number 201). FIG. 5 partly shows said vertical grooves 201 fitting onto the vertical protrusions (also referred to herein as threads) in the inside part of the cylindrical outer shell 102. The threads and grooves thus couple the capsules 200 to their positions inside the cylindrical outer shell 102. A person skilled in the art will appreciate that other fitting or locking means may be substituted for the threads and grooves 201 without departing from the spirit and scope of the present invention.

The vertical see-through slits 103 in the cylindrical outer shell 102 allow viewing of the level, color and texture of fluids in the capsules 200. User may recognize the fluid he or she wants to dispense based on the look and texture of the fluid, and determine how much of the fluid is left in the capsule 200. The vertical see-through slits 103 may be transparent portions of the cylindrical outer shell 102, or openings in the cylindrical outer shell 102. The vertical see-through slits 103 may be of any size and shape that enables a user to view the liquid in the capsules 200, or view a label affixed to the capsules 200.

In addition, in another embodiment of the presently disclosed MFD 100, the capsules 200 may be labeled to identify the fluid they contain. The label is positioned so that it is visible to the user via the vertical see-through slits 103. Said labels comprise, without limitation, stickers, prints, writing, or engravement. A person skilled in the art will appreciate that any conventional way of labeling an object is within the scope of the present invention. Said labels comprise text, drawings, symbols or a combination thereof. In some embodiments, the capsules 200 may be labeled for different kinds of fluids by the manufacturer. In yet other embodiments, the capsules 200 comprise stickers on which the user may write in order to label said capsules. In yet other embodiments, the capsules 200 comprise a designated area on which a label may be affixed, drawn or written by the user to allow viewing of the label via the see-through slit 103.

FIG. 6 illustrates an embodiment of a capsule 200. The capsule 200 comprises vertical grooves 201 designed to fit onto the vertical protrusions (threads) in the inside part of the cylindrical outer shell 102, thus securing the capsule 200 inside the cylindrical outer shell 102. The capsule 200 also features two straight sides 202 and one circular side, which enable efficient placement of multiple capsules 200 in the circular profile of the cylindrical outer shell 102 (as illustrated in FIG. 5). The capsule 200 is opened on one end. The opening part allows filling the capsule 200 with liquid, and attaching a pump cap 104 to said capsule. In the embodiment shown in FIG. 6, the pump cap 104 may be secured to the capsule 200 using a screw-on closure. A person skilled in the art will appreciate that the pump cap 104 may be secured to the capsule 200 using any other suitable mechanism, such as without limitation a snap-on closure.

Figure 8:
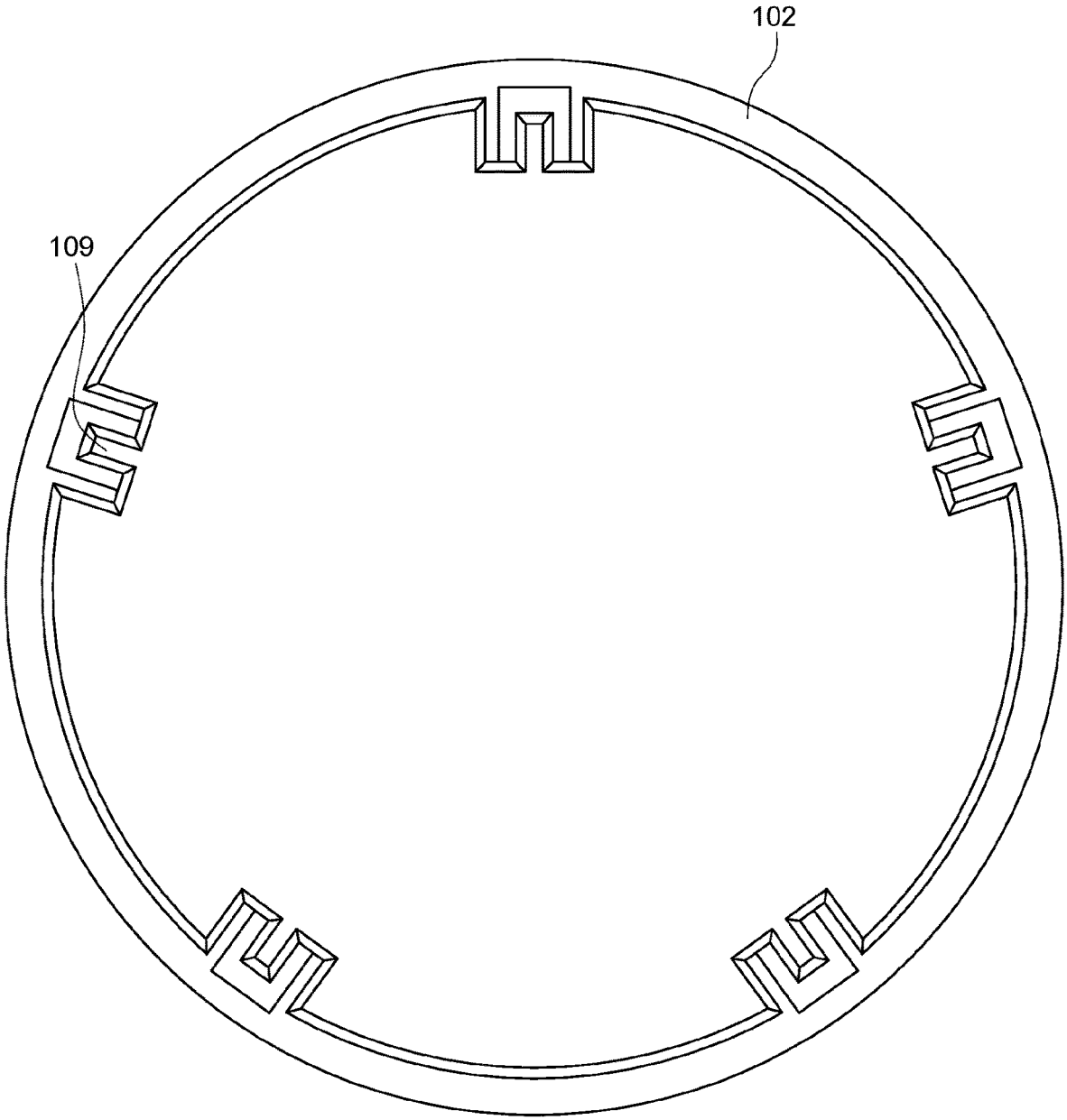
FIG. 8 illustrates a top view of an embodiment of the cylindrical outer shell.
Figure 9:
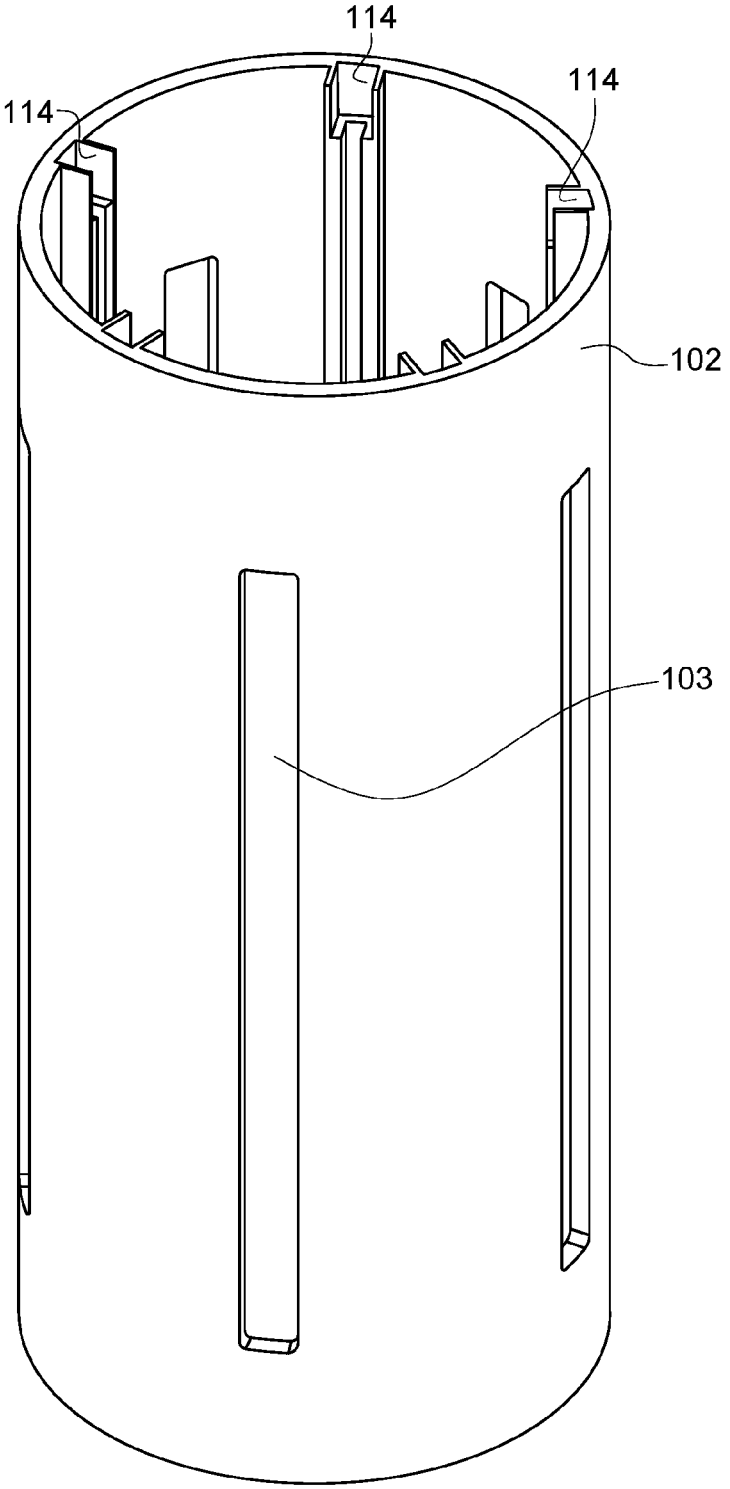
FIG. 9 illustrates a perspective view of an embodiment of the cylindrical outer shell.
Figure 11:
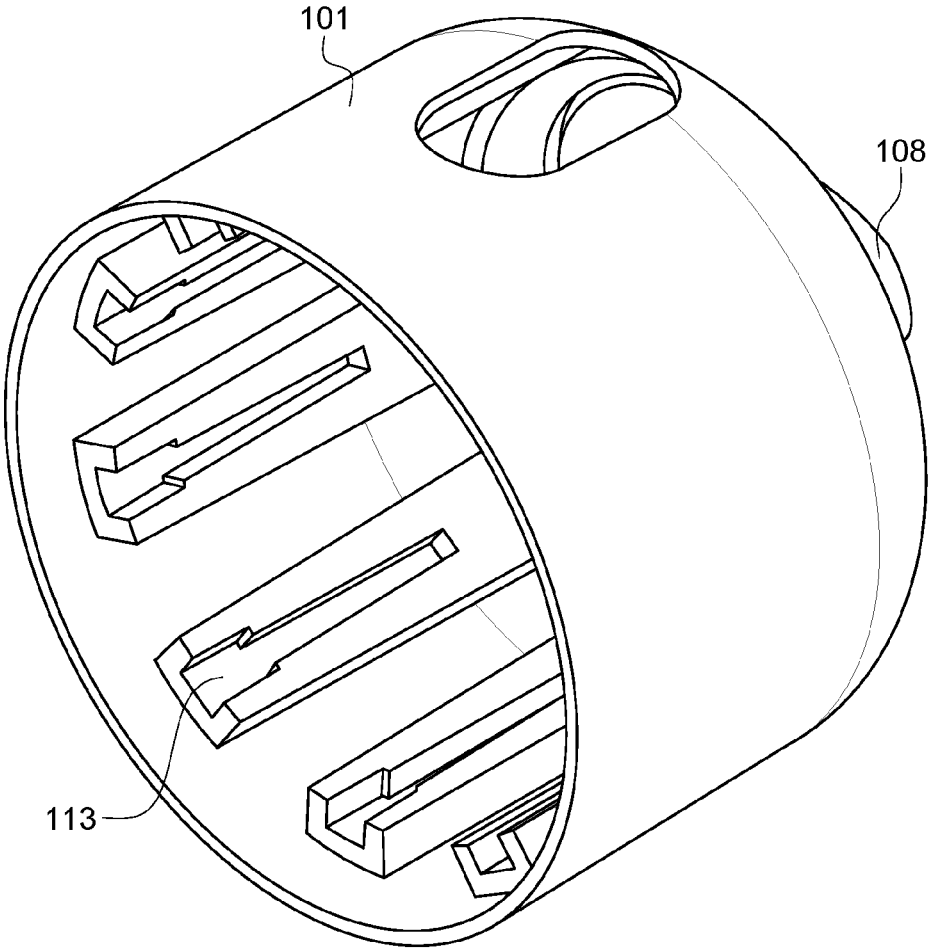
FIG. 11 illustrates a perspective view of an embodiment of the removable cap.

In some embodiments of the MFD 100, the removable cap 101 is secured to the cylindrical outer shell 102 using magnetic force attraction. FIG. 8 illustrates a top view of an embodiment of the cylindrical outer shell 102 depicting the profile of the vertical protrusions on the inside part of said shell. In the embodiment shown in FIG. 8, each said vertical protrusion define a space 109, wherein said space is wider at the open-end side, or top, of the cylindrical outer shell 102 (as shown in FIG. 9). In some embodiments, said wider space 114 at the top of the vertical protrusion is designed to secure a magnet. The terms "magnet" or "magnets" refer herein to magnet/s, permanent magnet/s, or ferromagnet/s. In the embodiment in which the removable cap 101 is secured to the cylindrical outer shell 102 using magnetic force attraction, the inside part of the removable cap 101 comprises vertical protrusions, wherein each said protrusion define a space 110, which is wider at the open end (bottom) of the removable cap 101, and designed to secure a magnet. An embodiment of the protrusions on the inside of the removable cap 101 is illustrated in FIG. 10 which depicts a top sectional view of the removable cap 101. An embodiment of said wider spaces 113 designed to secure magnets at the bottom of the removable cap 101 vertical protrusions is depicted in FIG. 11. The wider spaces 114, 113, designed to secure magnets on the cylindrical outer shell's vertical protrusions and the removable cap's vertical protrusions, respectively, may be of any shape and size, as desired and suitable to ensure the securement of the magnets. Accordingly, the magnets used for securing the removable cap 101 to the cylindrical outer shell 102 may be of any desired shape and size which fits securely in said wider spaces 113, 114 and thus secure the removable cap 101 to the cylindrical outer shell 102 with magnetic force attraction. The type of the magnets in the removable cap 101 and the cylindrical outer shell 102 is selected so as to create a magnetic force attraction between the removable cap 101 and the cylindrical outer shell 102. As an example, when the vertical protrusions of cylindrical outer shell 102 comprise magnets, then the vertical protrusions of the removable cap 101 may comprise ferromagnets. As another example, when the vertical protrusions of removable cap 101 comprise magnets, then the vertical protrusions of the cylindrical outer shell 102 may comprise ferromagnets. In a preferred embodiment, the removable cap 101 is secured to the outer cylindrical shell 102 using neodymium magnets. Each neodymium magnet has north and south side, and north of one magnet attracts the south of another magnet, and vice versa. Accordingly, if the removable cap's magnets are positioned so that their north side is facing outwards (away from the inside of said removable cap 101), the cylindrical outer shell's magnets are positioned so that their south side is facing outwards (away from the inside of said cylindrical outer shell 102). Similarly, if the removable cap's magnets are positioned so that their south side is facing outwards, the cylindrical outer shell's magnets are positioned so that their north side facing outwards. Thus, magnetic force attraction is created between the removable cap 101 and the cylindrical outer shell 102. Similar mechanism, utilizing neodymium magnets to generate magnetic attraction force, may be used to secure a deodorant to the closed end of the cylindrical outer shell 102.

In some embodiments in which the removable cap 101 is secured to the cylindrical outer shell 102 using magnetic force attraction, the removable cap 101 and the cylindrical outer shell 102 comprise the same number of magnets. In other embodiments, the removable cap 101 and the cylindrical outer shell 102 each comprise a different number of magnets. In the embodiment shown at least in FIGS. 9, 10 and 11, the removable cap 101 can be rotated horizontally by the user and be secured by magnetic attraction force in a number of pre-determined positions. In said pre-determined positions the side opening of the removable cap 101 is either in front of any one of the pump caps 104, or in between any two of the pump caps 104. When the removable cap 101 side opening is in front a pump cap 104 (as shown in at least FIG. 13), a user may press down on the partly detached portion 108 of the removable cap 101 and thus dispense liquid. When the removable cap 101 side opening is in between two pump caps, the partly detached portion 108 of the removable cap 101 cannot be used to easily pressed down on the pump caps; this position therefore prevents accidental dispense of liquid when the MFD 100 is not in use. In some embodiments of the MFD 100, some of the magnets in the removable cap 101 and cylindrical outer shell 102 overlap partly or completely when the removable cap 101 is secured to the cylindrical outer shell 102. In some embodiments of the MFD 100, some of the magnets in the removable cap 101 and cylindrical outer shell 102 do not overlap when the removable cap 101 is secured to the cylindrical outer shell 102. In a preferred embodiment, the magnets in the removable cap 101 and cylindrical outer shell 102 do not touch each other when the removable cap 101 is secured to the cylindrical outer shell 102. In the embodiment shown in FIG. 10, there are no magnets secured to the inside part of the removable cap 101 in the area that is immediately below the side opening. It will be appreciated by one skilled in the art, that any number of magnetic pieces may be used in the cylindrical outer shell 102 and removable cap 101 to secure said cap to said shell, while at the same time enable horizontal rotation of the removable cap 101.

Figure 12:
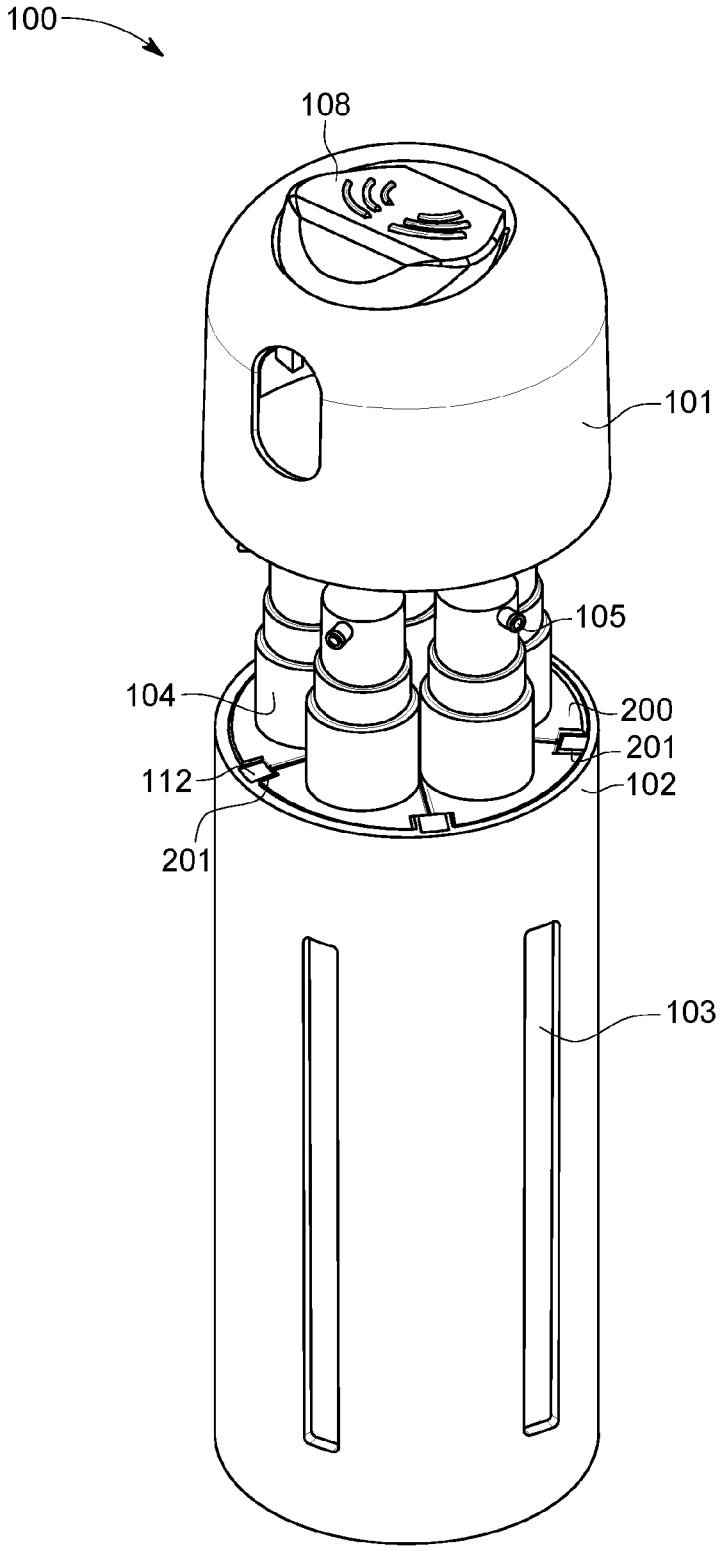
FIG. 12 illustrates a perspective view of an embodiment of the presently disclosed portable multi-fluid dispenser.

FIG. 12 illustrates an embodiment of the MFD 100 in which magnetic force attraction is used to secure the removable cap 101 to the cylindrical outer shell 102. The magnets 112 secured in the vertical protrusions of the cylindrical outer shell 102 are shown. The capsules 200 are secured in the cylindrical outer shell 102. The capsules 200 are in fluid communication with pump caps 104 comprising nozzles 105 and vertical see-through slits 103 in the cylindrical outer shell 102 allow for viewing the capsules 200 content. The removable cap 101 is shown un-secured to the cylindrical outer shell 102, and it comprises a side opening and a partially detached top part 108. In the embodiment depicted in FIG. 12, the top of the magnets 112 secured in the cylindrical outer shell 102 is level with the top of the capsules 200 also secured in the cylindrical outer shell 102. This allows the removable cap 101, when secured to the cylindrical outer shell 102, to rotate horizontally to enable the side opening of the removable cap 101 to be positioned in front of a pump cap 104 of choice, or in between two pumps caps 104 to prevent dispense of liquid. When the removable cap 101 is rotated so that the side opening of the removable cap 101 is positioned in front of a pump cap 104 of choice, it is secured to said position by the magnetic attraction force, and allows for a convenient dispense of liquid by the user. The magnetic force attraction is strong enough so that the removable cap 101 stays in the desired position while a user presses down of the partly detached portion 108 of the removable cap 101 to dispense fluid. However, said magnetic force attraction is not strong enough to prevent a user from rotating the removable cap 101 horizontally, for example, to another secured position to enable dispense of liquid from another capsule 200, or to place the side opening of the removable cap 101 in between two pump caps 104 to prevent dispense of liquids. The magnets secured in the removable cap 101 and the cylindrical outer shell 102 provide axial locking and rotational alignment functionality between the removable cap 101 and the cylindrical outer shell 102. Said magnets hold the removable cap 101 and the cylindrical outer shell 102 axially together with magnetic attraction force, and also enable rotationally in a variety of selectable, pre-determined locations. The user must overcome the magnetic attraction force to cause any relative movement (axial or rotational) between the removable cap 101 and the cylindrical outer shell 102.

Magnets according to the present disclosure are any material or object that produces a magnetic field, or material that is magnetized and creates its own magnetic field. Magnets according to the present disclosure can be magnets, permanent magnets, or a ferromagnets. Unlimiting example for magnetic material which may be used according to the present disclosure include: ferrimagnetic materials (such as ferrites, magnetite and lodestone), ferromagnetic materials (such as iron, nickel, alnico, ferrite, cobalt and some alloys), paramagnetic substances (such as platinum and aluminum) and diamagnetic materials (such as carbon and copper). In preferred embodiments, the magnets are Neodymium Magnets.

Figure 13:
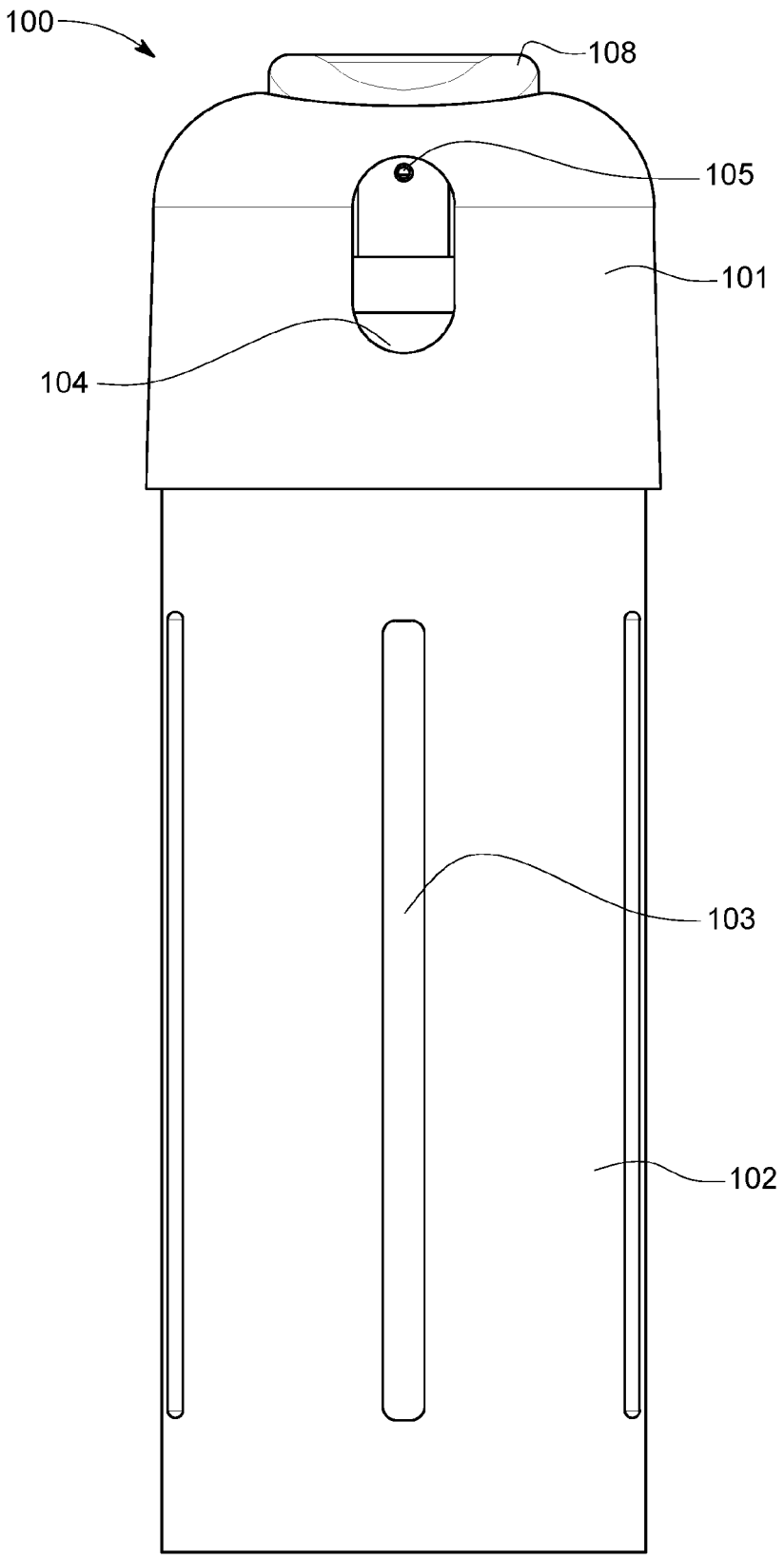
FIG. 13 illustrates a side view of the presently disclosed portable multi-fluid dispenser.

FIG. 13 illustrates a side view of the MFD 100 featuring the removable cap 101 secured to the cylindrical outer shell 102. The removable cap 101 features the partly detached portion 108 and side opening, wherein a pump cap 104 can be seen through said side opening. The cylindrical outer shell 102 comprises vertical see-through slits 103.

Figure 7:
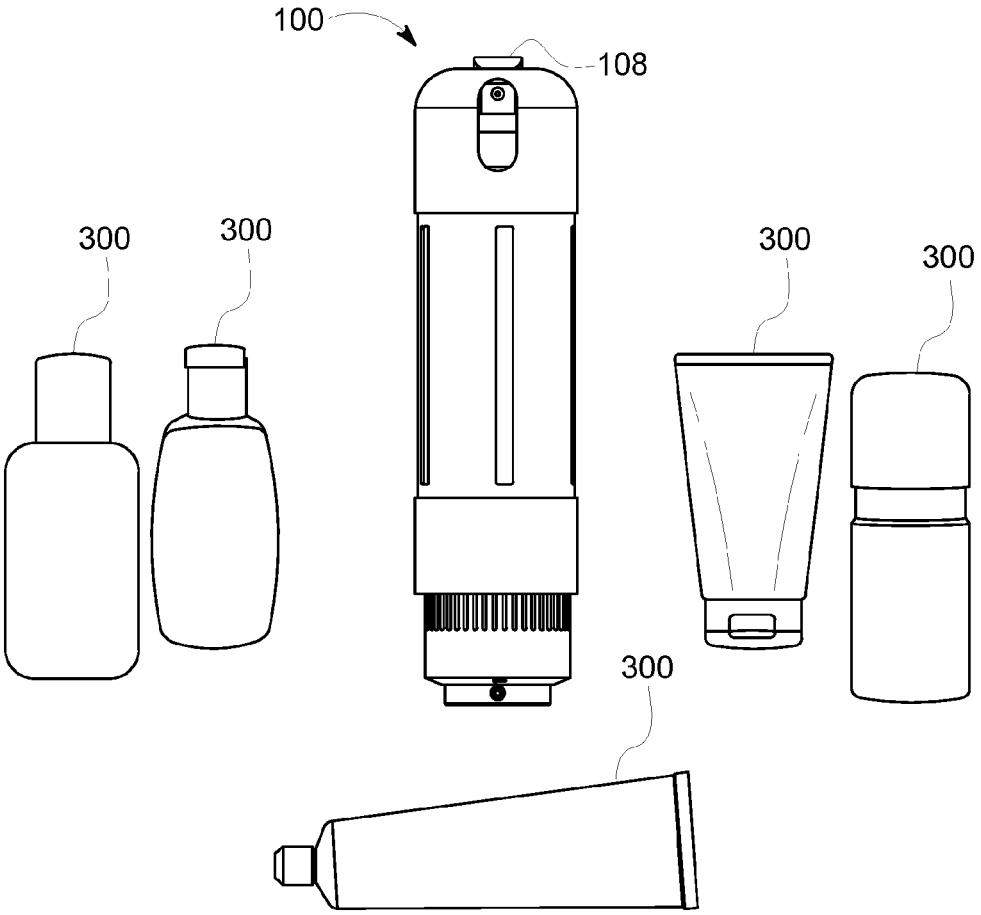
FIG. 7 illustrates a perspective view of an embodiment of the presently disclosed portable multi-fluid dispenser next to a variety of toiletry containers.

FIG. 7 illustrates the MFD 100 next to various containers of products 300.

In some embodiments, the presently disclosed MFD 100 comprises 4 capsules 200. Each of the said capsules may contain 10-100 ml; preferably each capsule 200 contains 25 ml.

In some embodiments, the presently disclosed MFD 100 comprises 5 capsules 200. Each of the said capsules may contain 10-100 ml; preferably each capsule 200 contains 49 or 50 ml.

In some embodiments, the presently disclosed MFD 100 comprises 2-6 capsules 200. Each of the said capsules may contain 10-100 ml; preferably each capsule 200 contains 25 ml.

In yet another embodiment of the presently disclosed MFD 200, said MFD is disposable.

In yet another embodiment of the presently disclosed MFD 200, the capsules 200 are disposable.

The MFD disclosed herein may be used to separately store and dispense a plurality of fluids. It is expressly contemplated herein that any fluid of choice may be stored, transported, and/or dispensed using the presently disclosed MFD. Such fluids may be, but not limited to, liquid soap, shampoo, conditioner, body wash, face wash, skin lotion, and various oils. Said various oils may be any oil, such as, without limitation, oils used for any skin care, mechanic work, or cooking/preparation of food. Another example for fluids which may be stored, transported, and/or dispensed using the presently disclosed MFD is various condiments such as, without limitation, ketchup, sauces, mayonnaise, mustard, or dressings such as ranch, or any other type of dressing.

The invention claimed is:

1. A multi-fluid dispenser comprising:

a cylindrical outer shell closed on one end;

a removable cap which may be removably secured to the open end of cylindrical outer shell and thus closes said open end of cylindrical outer shell, wherein said removable cap rotates horizontally while secured to the cylindrical outer shell;

a plurality of capsules closed on one end which removably fit inside said cylindrical outer shell, wherein when inside cylindrical outer shell, the closed end of the plurality of capsules is proximal to the close end of the cylindrical outer shell; and a plurality of pump caps, each pump cap of said plurality of pump caps in fluid communication with a capsule of said plurality of capsules for dispensing fluid from said capsules, wherein said plurality of pump caps are removably fitted on openings of said plurality of capsules;

wherein an inside, part of the cylindrical outer shell comprises a plurality of vertical protrusions; and wherein the outside of each capsule of the plurality of capsules comprises two vertical grooves, and wherein said two vertical grooves fit onto said, plurality of vertical protrusions of said inside part of the cylindrical outer shell.

2. The multi-fluid dispenser as recited in claim 1, wherein said cylindrical outer shell comprises a plurality of vertical see-through slits, wherein said plurality of vertical see-through slits allow viewing of the level, color and texture of fluids in said plurality of capsules, and wherein said texture comprises of characteristics such as viscosity and opacity.

3. The multi-fluid dispenser as recited in claim 2, wherein said plurality of vertical see-through slits allow viewing of labels affixed to said plurality of capsules, and wherein said labels comprise stickers, prints, writing or engravements.

4. The multi-fluid dispenser as recited in claim 3, wherein said removable cap is secured to the cylindrical outer shell by magnetic force attraction, and wherein a user may remove said removable cap from said cylindrical outer shell by pulling.

5. The multi-fluid dispenser as recited in claim 4, wherein a side portion of said removable cap comprises a side opening through which a dispensed fluid may be collected.

6. The multi-fluid dispenser as, recited in claim 5, wherein a top portion of said removable cap comprises a partly detached portion comprising a protrusion into the inside of said removable cap, and wherein said partly detached portion may be pressed down to allow said protrusion to press down on one pump cap of said plurality of pump caps and thus cause fluid present in a capsule of said plurality of capsules which is in fluid communication with said one pump cap of said plurality of pump caps to be dispensed.

7. The multi-fluid dispenser as recited in claim 6, wherein said removable cap can be secured to the cylindrical outer shell in a number of pre-determined positions, and wherein the side opening can be thus positioned in front of a pump cap of said plurality of pump caps according to the users choice; and wherein, alternatively the side opening can be positioned in between two pump caps of said plurality of pump caps, and wherein said position in between two pump caps of said plurality of pump caps prevents dispense of fluids.

8. The multi-fluid dispenser as recited in claim 7, wherein said plurality of capsules comprises 4 capsules.

9. The multi-fluid dispenser as recited in claim 7, wherein said plurality of capsules comprises 5 capsules.

10. The multi-fluid dispenser as recited in claim 7, wherein said multi-fluid dispenser is disposable.

11. The multi-fluid dispenser as recited in claim 7, wherein said plurality of capsules are disposable.

12. The multi-fluid dispenser as recited in claim 7, further comprising a spray deodorant, wherein said deodorant is attached to the closed end of said cylindrical outer shell via a tight-fitting sleeve.

13. The multi-fluid dispenser as recited in claim 7, further comprising a spray deodorant, wherein said deodorant is attached to the closed end of said cylindrical outer shell by magnetic force attraction.

14. A method of using the multi-fluid dispenser as recited in claim 7 comprising the steps of:

(a) pulling off the removable cap from the cylindrical outer shell;

(b) filling a desired number of capsules of the plurality of capsules with liquids of choice;

(c) securing a pump cap of the plurality of pump caps on each capsule of the plurality of capsules;

(d) labeling the capsules of the plurality of capsules according to content;

(e) inserting the plurality of capsules of step (d) into the cylindrical outer shell;

(f) re-placing the removable cap onto the cylindrical outer shell;

(g) rotating the removable cap horizontally so that the side opening of the removable cap is in front of a pump cap of a user's choice of the plurality of pump caps; and, (h) pressing down on the partly detached portion of the removable cap to dispense liquid, wherein each time the partly detached portion is pressed down a certain amount of said liquid is dispensed, thus step (g) may be performed as many times as needed to dispense the desired amount of liquid.

* * * * *